United States Patent [19]

Morgan

[11] 4,347,876

[45] Sep. 7, 1982

[54] HANDLING AND/OR TREATMENT OF PARTICULATE MATERIALS

[75] Inventor: John H. Morgan, Syston, England

[73] Assignee: Richards Structural Steel Co., Ltd., Leicester, England

[21] Appl. No.: 169,343

[22] Filed: Jul. 16, 1980

[30] Foreign Application Priority Data

Jul. 19, 1979 [GB] United Kingdom ..... 79/25126

[51] Int. Cl.[3] ..... B65B 1/30; B65B 31/00

[52] U.S. Cl. ..... 141/70; 141/94

[58] Field of Search ..... 141/11, 70, 85, 94, 141/95, 96

[56] References Cited

U.S. PATENT DOCUMENTS 4,170,251 10/1979 Hine ..... 141/11

4,213,489 7/1980 Cain ..... 141/11

FOREIGN PATENT DOCUMENTS 492676 3/1937 United Kingdom .

461930 11/1975 United Kingdom .

*Primary Examiner*—Richard R. Stearns

*Attorney, Agent, or Firm*—Allison C. Collard; Thomas M. Galgano

[57] ABSTRACT

The invention relates to the handling of particulate materials such as foundry molding sand requiring cooling. The operating vessel has an inlet, through which material is charged to flow-downwardly in the vessel against an upward flow of pressurized fluid, usually air, there being provided sensing and signalling probes to sense the height of the fluidized material in the vessel at a pedetermined maximum level in the vessel and at a predetermined minimum level. These sensing and signalling probes control the outlet of cooled sand from the bottom of the vessel, stopping it when the minimum level is sensed and re-commencing discharge when the maximum level is reached.

3 Claims, 4 Drawing Figures

HANDLING AND/OR TREATMENT OF PARTICULATE MATERIALS

BACKGROUND OF INVENTION

The invention relates to apparatus for the handling and/or treatment of particulate materials. Examples of particulate materials are sand, gypsum or cement and these may conveniently be treated using a fluidizing technique. The term "treatment" refers to such processes as heating, cooling, moistening or drying.

In an example of the treatment of particulate material according to the invention, foundry molding sand may have to, from time to time, be cooled so that it can continuously be recycled. It will be understood that the sand becomes heated as a result of contact with molten metal during molding operations, although such heating is not uniform. In order to successfully recycle the sand, it should be cooled to a fairly uniform level.

It has previously been considered whether it is possible to cool this sand by fluidization, but hitherto, attempts have met with only limited success. This is because clay-bonded molding sand from which the castings have been removed can vary widely in moisture content and contains a proportion of agglomerates in the form of chemically-bonded core sand and fragments of solidified metal. When such sand is therefore treated in a conventional horizontal fluidized bed, the bed is quickly rendered inoperative by clogging of the inlets for the fluidizing medium.

A further disadvantage arises where there is a wide range of particle size to be treated, since the velocity of the fluidizing medium required for large particles will be substantially greater than that for smaller particles. Thus when a sufficiently high velocity is reached for the larger particles, say 12 meters/minutes for 50$\mu$ particles, the smaller particles, say 10$\mu$, tend to be lost into the ambient area and present a severe dust problem besides loss of sand.

The invention sets out to alleviate the above problems.

SUMMARY OF THE INVENTION

The invention provides apparatus for the handling and/or treatment of particulate materials, comprising a vessel having an outlet flue and an inlet at an upper region thereof, said inlet allowing entry of particulate material which is to be passed in an at least substantially downward direction through the vessel, means for passing pressurized fluid upwardly through the vessel towards the outlet flue, an outlet at or adjacent a base portion of the vessel, means to control discharge of material from the outlet, sensing and signalling means arranged to sense the height of fluidized material in the vessel at a predetermined maximum level and at a predetermined minimum level and control means adapted to operate the means to control discharge of the particulate material when a signal is received that the maximum level has been reached and to cease discharge when the minimum level has been reached.

If required, water sprays may be incorporated in the vessel at an upper region thereof, the operation of which is controlled by signals from a moisture sensing means. Alternatively, a temperature sensing means may be used which senses high temperatures which require additional water.

The use of the apparatus therefore results in the discharge of cooled sand of substantially uniform moisture content, together with the over-size particles which would have resulted in clogging of a conventional fluidized bed.

Advantageously, the discharge outlet may be provided with, for example, a discharge conveyor, an upper run of which passes in close proximity to the outlet, so that when the conveyor movement is halted, the outlet is effectively closed by the presence of the discharged material on the stationary conveyor.

It may be found advantageous to incorporate in the apparatus a suitable form of velocity sensing means to monitor the velocity of the fluidizing medium within the vessel. This may be necessary because, in the case of air supplied to materials which are at a sufficiently high temperature to cause a significant rise in the temperature of the air causing expansion thereof, there is a consequent marked increase in velocity. This must be compensated for to avoid excessive elutriation. A signal from the velocity sensing means, which may be conveniently placed in the vessel outlet duct, may therefore be used to control (reduce) the amount of air supplied to ensure that conditions return to normal.

Alternatively, the velocity sensing means may take the form of a further temperature sensor used to signal a change in the air temperature and therefore air volume during operation, such a change being used to monitor changes in air flow conditions which have occurred despite a constant level of air input. Thus, the situation of increased temperature and air flow through the outlet flue may be remedied by a controlled reduction in the level of air input. It will be appreciated that at such higher temperature, the amount of air needed to evaporate a given amount of moisture is considerably less, so that reduction in the air input minimally detracts from control of the operation.

BRIEF DESCRIPTION OF DRAWINGS

There will be described an apparatus according to the invention. It will be understood that the description which is intended to be read with reference to the accompanying drawings, is given by way of example only and not by way of limitation.

In the drawings.

DETAILED DESCRIPTION OF DRAWINGS

Figure 1:
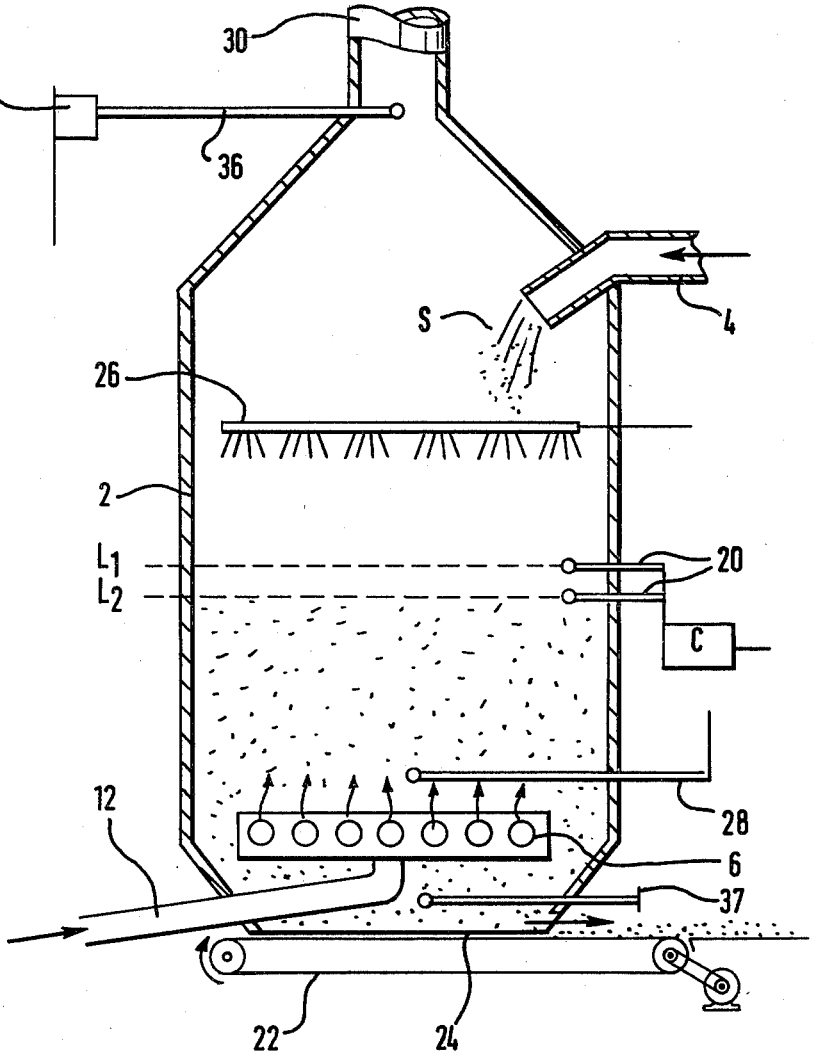
FIG.1 shows a diagrammatic longitudinal sectional view through the apparatus.
Figure 2:
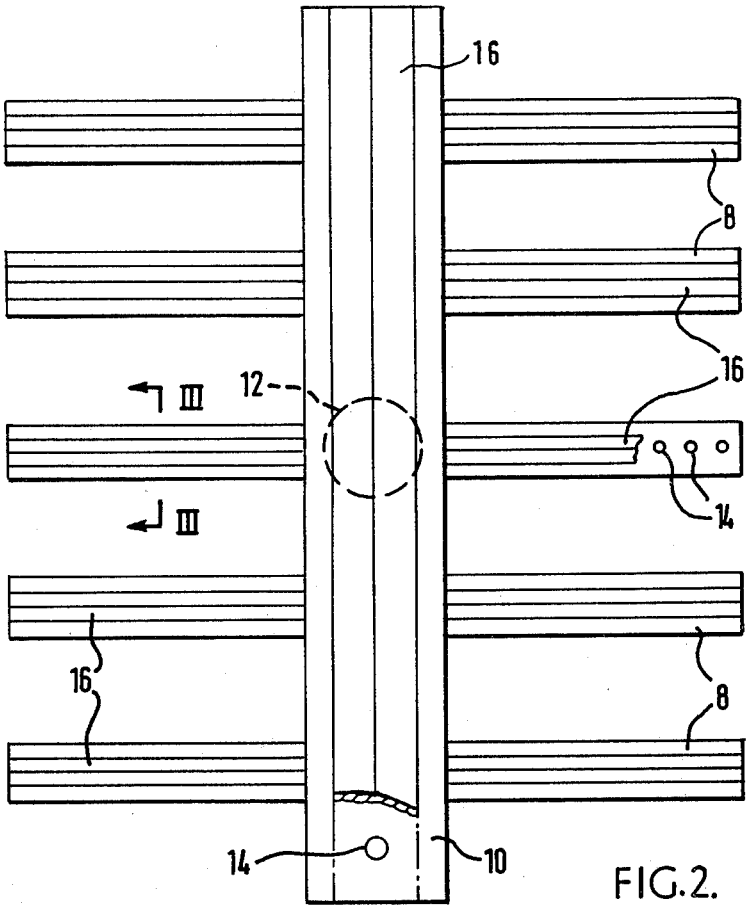
FIG. 2 shows a plan view of an air-distributing device.

FIG. 1 shows a vessel comprising a hopper 2 through which hot sand S is arranged to descend from a charging inlet 4. A multiple-pipe air device 6 is provided at a lower region of the hopper to provide air under pressure so as to achieve fluidization of the sand within the hopper.

Figure 3:
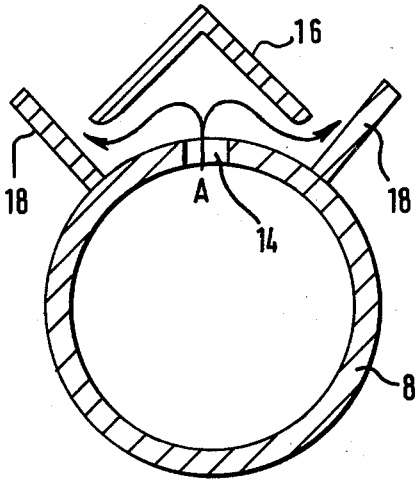
FIG. 3 is a cross-sectional view of a pipe of FIG. 2 taken on line III—III of FIG. 2.
Figure 4:
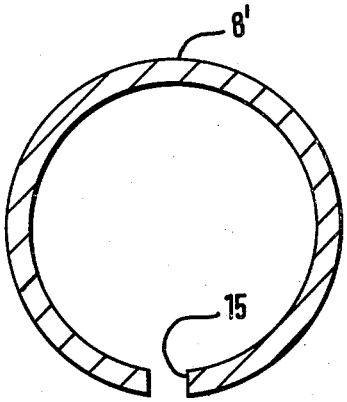
FIG. 4 is a cross-sectional view of an alternative arrangement of the pipe to that shown in FIG. 3.

Details of the air pipe device are illustrated in FIGS. 3 and 4 which show a plurality of pipes 8 connected to a common head 10 to which cooling air is supplied under pressure through a pipe 12 from a blower (not shown). At the upper side of each pipe in the present example is a cover plate 16 in the form of a strip of angle iron which acts to prevent entry of sand into apertures 14 in the pipes and to deflect the direction of emission of the jets of air to improve the distribution and pressure effect.

Alternatively, where material leaves the discharge outlet through a sealed outlet, for example to a pneumatic conveying vessel, a simple pipe arrangement, with, say, apertures 15 on the under side of each pipe 8', will be adequate because of the improved seal at the bottom of the vessel.

This effect may be further controlled by the provision of fins 18 radiating from the pipe 8 to deflect the air in the direction of the arrows A.

Air leaving the air device 6 under pressure passes upwardly through the sand to maintain it in a fluid condition. The height of the fluidized sand is monitored by two sensing probes 20, the upper one of which senses when the height reaches the maximum desirable level, as when the hopper is being charged. The lower probe senses when the minimum desirable level is reached. Signals from the probes are received at a control means C which operate a horizontal conveyor belt 22, the upper run of which lies adjacent to a discharge outlet 24 of the hopper.

Thus, when a signal is received from the upper one of the probes 20 that the maximum level $L_1$ is reached the conveyor 22 will start up and carry away sand falling upon its upper run through outlet 24. When the minimum level $L_2$ is reached, a signal from the lower probe will halt the conveyor 22 and the sand will accumulate on the stationary upper run thereby effectively closing the outlet 24.

Where a uniform moisture content is required in the discharged sand, use may be made of water sprays 26 provided at an upper region of the hopper and operated under the control of a moisture sensitive probe 28 positioned within the descending sand.

Water sprays serve two purposes, the first being to supply water for evaporation in order to provide the necessary cooling by evaporation and the second to ensure uniform moisture level in the discharging sand, the reason for this latter need being that from time to time extremely dry sand may be fed to the cooler.

Because of the link between temperature and capacity to absorb moisture in air is so clearly defined in the science of hygrometry it is possible to provide improved moisture control simply by means of temperature sensing. However, when tighter control is required a specific moisture sensing device 37 is located above the discharge to override the temperature sensor as may be necessary.

A velocity sensing means 34 having a probe 36 is provided in an outlet 30 at an upper region of the vessel in order to monitor changes in air velocity leaving the vessel which may cause a loss of efficiency due to excessive elutriation. Where conditions are such that the temperature of the material is sufficient unduly to raise the temperature of the fluidizing medium, in this case air, to a level at which there is expansion to, say, double the intended volume, the result, because the vessel size is constant, is an undesired increase in air velocity. This must be compensated for by a reduction in air input rates, and it is arranged that a signal from the sensing means 34 causes an appropriate reduction in the air supply through the pipe 12.

Various modifications may be made within the scope of the invention as defined in the following claims.

I claim:

1. An apparatus for the handling and/or treatment of particulate materials, comprising:

a vessel having a gas outlet flue and a material inlet at an upper region thereof, said inlet allowing entry of particulate material which is to be passed in at an at least substantially downward direction through the vessel, means for passing pressurized gases upwardly through the vessel towards said gas outlet flue, and a second outlet adjacent to a base portion of said vessel;

a discharge conveyor having an upper run positioned to receive material discharging from said second outlet;

sensing and signalling means arranged for sensing the height of fluidized material in said vessel at a predetermined maximum level and a predetermined minimum level and for generating a signal relative thereto, respectively; and control means adapted to receive said signals and to operate said discharge conveyor to allow discharge of the particulate materials when a signal is received that the maximum level has been reached, and to cause said discharge to cease when a signal is received that the minimum level has been reached, wherein said upper run of the discharge conveyor passes in such close proximity to said second outlet that when, in operation of the apparatus, the conveyor is halted, said second outlet is effectively closed by the presence of the discharged material on said conveyor upper run.

2. The apparatus as claimed in claim 1, wherein air velocity sensing means are provided adjacent to the outlet flue to detect and signal changes in air flow velocities due to excessive expansion of air volume.

3. The apparatus as claimed in claim 1 or 2, wherein water sprays are provided in the vessel at an upper region thereof and moisture sensing means are provided to control operation of said sprays to produce discharged material of substantial uniform moisture content.

* * * * *